US005755073A

United States Patent [19]

Moncreif et al.

[11] Patent Number: 5,755,073

[45] Date of Patent: May 26, 1998

[54] PACKAGING MACHINE WITH FREE FLOATING COMPRESSION SECTION

[75] Inventors: Frank Moncreif, Acworth; Jeff Disrud, Marietta, both of Ga.

[73] Assignee: Riverwood International Corporation, Atlanta, Ga.

[21] Appl. No.: 660,557

[22] Filed: Jun. 7, 1996

[51] Int. Cl.[6] ..... B65B 21/00

[52] U.S. Cl. ..... 53/48.1; 53/244; 53/534; 198/626.5; 198/626.6

[58] Field of Search ..... 493/479, 478, 493/475; 53/48.1, 257, 259, 387.1, 387.2, 244, 534; 198/626.1, 626.5, 626.6

[56] References Cited

U.S. PATENT DOCUMENTS

| | | | |
|---|---|---|---|
| Re. 34,839 | 1/1995 | Tolson | 198/626.6 |
| 3,145,518 | 8/1964 | Ricca | 53/387.2 |
| 3,386,565 | 6/1968 | Carter | 198/626.6 |
| 3,517,482 | 6/1970 | Beninger | 53/387.2 |
| 4,015,722 | 4/1977 | Cooper, Jr. et al. | 198/626.1 |
| 4,438,617 | 3/1984 | Ulrich et al. | 198/626.5 |
| 4,748,794 | 6/1988 | Marchetti | 493/478 |
| 5,044,269 | 9/1991 | Bielfeldt | 198/626.6 |
| 5,456,058 | 10/1995 | Ziegler | 53/48.1 |
| 5,492,216 | 2/1996 | McCoy et al. | 198/626.5 |

*Primary Examiner*—James F. Coan
*Assistant Examiner*—Gene L. Kim

[57] ABSTRACT

An article packaging machine comprises a frame, a carton conveyor mounted to the frame for conveying cartons along a carton path, and an infeed conveyor assembly for grouping articles such as beverage cans into groups of predetermined size and moving them toward and into open cartons moving along the carton path. When the cartons are packed with articles, adhesive is applied to the flaps of their open ends and the flaps are folded over onto themselves. A spring biased free floating compression section has a pair of opposed compression belt assemblies that are yieldably spring biased toward each other to apply pressure to the ends of the containers to set the adhesive, thus sealing the ends of the packaged cartons shut. When the cartons are sealed, they are ejected from the packaging machine by a pair of opposed ejector belt assemblies.

5 Claims, 4 Drawing Sheets

PACKAGING MACHINE WITH FREE FLOATING COMPRESSION SECTION

FIELD OF INVENTION

This invention relates generally to packaging machines for grouping articles into groups of a predetermined number and directing the groups toward and into open containers such as preformed paperboard cartons moving along a carton path. More particularly, the invention relates to beverage container packaging machines and specifically to compression sections of such machines.

BACKGROUND OF THE INVENTION

Various types of packaging machines or cartoning apparatus are designed to package articles, such as bottles or cans, into a unitary container such as a preformed paperboard carton. Although the ultimate intended goal of these types of packaging machines is the same, that is, to package a desired number of articles in a specific orientation, the methods and apparatus for accomplishing this goal are diverse. Typically, the articles are grouped in some manner to correspond with approximate container dimensions, and the article group is transferred into the container. As a final processing step, the container is closed around the article group. Such containers can either be substantially flat, creased carton blanks that are folded around the article group, or partially formed, open-ended containers into which the articles are directed through one open end. The container ends are then closed by folding flaps across the open ends and gluing the flaps together whereupon pressure is applied to the flaps for a predetermined length of time to permit the glue to set, thus sealing the carton shut. An example of such a packaging machine is disclosed in U.S. Pat. No. 5,546,734, issued Aug. 20, 1996, the specification of which is hereby incorporated by reference.

In many modern packaging machines, open cartons are conveyed along a carton path by pairs of upstanding pusher lugs connected to the upper flights of spaced apart endless conveyor chains. The lugs typically extend upwardly between successive cartons on the carton path and are moved along by the endless conveyor chains to push the cartons along the path. As the cartons are conveyed along the carton path, randomly ordered articles such as beverage cans are formed into groups by an adjacent infeed conveyor assembly and the grouped articles are then moved progressively toward and into the open cartons moving along the carton path.

When each carton is filled, adhesive is applied to the flaps of its open end or ends and the flaps are folded over onto each other to close the end of the carton. The closed carton then enters a compression section of the machine. In the compression section, the cartons move between a pair of moving compression belts where pressure is applied to the closed flaps of the container for a predetermined length of time to allow the adhesive to set and bond the flaps together. When the adhesive has set, the packaging operation is complete and the sealed carton is gripped by a pair of opposed ejector belts and accelerated out of the machine at the downstream end thereof. The acceleration of the cartons by the ejector belts pulls them away from their pusher lugs at the proper speed to insure that the lugs do not give the cartons a kick and damage them as the lugs begin to rotate around their downstream sprockets. In practice, cartons are conveyed in closely spaced sequence along the carton path where they are sequentially filled with beverage cans, glued shut, and ejected from the machine at a rapid rate.

In such packaging machines, it is common for the carton path to be adjustable in width to accommodate cartons of different sizes. In the packaging machine disclosed in copending application Ser. No. 08/118,111, for example, the carton path is defined on one side by a first pusher lug guide rail and on the other side by a second pusher lug guide rail that extends parallel to the first. The cartons rest at their opposed ends on the guide rails. The pairs of upstanding pusher lugs are supported on and ride along the guide rails for spacing the cartons and pushing them along the carton path. The first guide rail in this example is fixed and the second guide rail is attached to a laterally adjustable accessory rail that extends along the entire length of the packaging machine. The accessory rail supports the second pusher lug guide rail and a variety of other functional components of the packaging machine, including components of the compression section and ejector belt assembly thereof. In this way, the lateral position of all the components attached to the accessory rail can be adjusted simultaneously with the accessory rail to accommodate different size cartons.

In the past, various designs for the compression sections of article packaging machines have been implemented. In one such design, upstanding endless moving belts are provided on either side of the carton path. Each of the belts has an inside flight that is substantially vertically oriented and that extends along one side of the carton path opposing and spaced from the inside flight of the other belt. The belts are driven to move their inside flights in the downstream direction of the machine. As packaged and closed cartons move into the space between the opposed inside flights of the belts, they are compressed slightly between the belts. This, in turn, applies pressure to the ends of the cartons to hold the closed flaps of the cartons together so that the adhesive previously applied thereto can set to bond the flaps together and seal the carton end. The length of the inner flights of the compression belts is selected to provide pressure on the closed flaps for a time sufficient to allow the adhesive to set before the carton is ejected from between the belts and from the packaging machine by the ejector belt assembly.

Such moving belt compression sections of packaging machines, while relatively successful, have nevertheless exhibited certain problems and shortcomings. One such problem has resulted from the fact that beverage cans and bottles can vary slightly in diameter from manufacturer to manufacturer and perhaps even as a function of the pressure of carbon dioxide within the containers. Thus, when a number of beverage containers are packaged in a carton, the length of the carton from end to end can also vary slightly. This causes a problem with opposed belt compression sections wherein the belts are laterally fixed relative to each other. In instances where the beverage containers are slightly smaller in diameter than the norm, for example, the inwardly opposed pressure provided by the belts may not be sufficient to hold the flaps together with enough force for the adhesive to set properly. Conversely, in instances where beverage containers are slightly larger in diameter than the norm, resulting in a carton that is slightly longer than average, the packaged cartons can fit too tightly between the belts and too much pressure can be applied, leading to possible rupture of the containers or machine jams.

One method of addressing the problems that arise from the variations in container diameter has been to provide a series of spring loaded rollers or plates extending along and behind the inner flight of at least one of the compression belts. The spring loaded rollers or plates bear against the back of the flight at successive locations therealong and tend to bias the flight toward the carton path and toward the flight of the opposing belt. As cartons move along between the flights, the rollers or plates successively spring out or in as necessary to accommodate the slightly varying width of the packaged beverage containers.

While this arrangement represents an improvement over fixed compression sections, it has proven to have its own problems. Specifically, the series of independent spring biased rollers or plates that bias the belt inwardly do not tend to provide evenly distributed pressure across the entire width of the carton and its flaps. Thus, in some instances, the flaps are not held together with sufficiently uniform force to allow the adhesive to set properly. In addition, the mechanisms for providing the successive spring biased rollers or plates are relatively complex, expensive to manufacture, and can require substantial maintenance. Finally, where spring biasing has been provided on only one side of the carton path, it has been found that the cartons become slightly off-centered as they move into and through the compression section between the compression belts. This is undesirable and can cause problems such as machine jams. It is much more desirable that the cartons remain centered in the carton path as they traverse the compression section.

Another problem with prior art packaging machines has been related to their ejector belt assemblies. These assemblies also comprise opposed moving endless belts that grip the cartons as they pass beyond the compression belt assemblies and move the cartons on out of the machine. The speed of the ejector belts is set to accelerate the cartons to move them beyond the upstanding pusher lugs that push them along the carton path before the lugs begin to round their downstream sprockets. This insures that the pusher lugs do not give the cartons a kick that can damage them as the lugs begin to rotate around their downstream sprockets. It is also important that the cartons not be accelerated so fast that they overrun their leading pusher lugs, which can also cause damage.

In prior art packaging machines, the ejector belt assemblies have resembled the compression belt assemblies but typically are operated at a greater speed to accelerate cartons away from their pusher lugs and away from the compression belt assemblies. More specifically, ejector belt assemblies have comprised a pair of infeed pulleys spaced across the carton path at the infeed end of the ejector belt assembly and a pair of idler pulleys spaced across the carton path at the other end of the ejector belt assembly. An endless belt extends around the infeed and idler pulleys on each side of the carton path and each belt has an inner flight that borders the carton path and opposes the inner flight of the other belt. The infeed pulleys are driven to move the facing flights of the belts in the downstream direction of the carton path.

In the past, the infeed pulleys of ejector belt assemblies have been laterally fixed with respect to each other. This has resulted in a problem in that slight variations in the widths of cartons as a result of variations in the diameters of containers within the cartons could cause cartons to be gripped to loosely or too tightly as they moved between the infeed pulleys. One attempted solution has been to offset the infeed pulleys slightly back from the planes of the inner flights of the belts. While this helped, it nevertheless created its own problems. Specifically, cartons would be gripped by the now tapered infeed ends of the ejector belts at slightly differing times, depending upon the widths of the cartons. In some instances, where a carton was slightly narrower than the norm, the carton would be gripped by the ejector belts too late to pull the carton away from its trailing pusher lugs. In these instances, the trailing pusher lugs would impact and damage the cartons as the lugs begin to rotate around their downstream sprockets. In other instances, where cartons were slightly wider than the norm, the cartons would be gripped too early and pulled from the compression section before their leading pusher lugs had moved out of the way around their sprockets. In these cases, the carton would be pulled across the leading pusher lugs, thereby damaging the carton.

Accordingly, there exists a continuing and heretofore unaddressed need for an article packaging machine with an improved compression section that is mechanically efficient with a minimum of moving parts. The improved compression section should accommodate slight variations in carton width due to variations in container diameter while at the same time applying evenly distributed pressure across substantially the entire closed end of a carton. The compression section should be reliable, automatically adjusting, and relatively maintenance free for long periods of machine operation. Furthermore, the improved compression section should include an ejector belt assembly that grips cartons as they leave the compression belt assemblies at a precisely controllable position on the carton path so that the cartons are accelerated away from their pusher lugs without either the trailing or the leading pusher lugs impacting and damaging the cartons. It is to the provision of a packaging machine with such a compression section that the present invention is primarily directed.

SUMMARY OF THE INVENTION

Briefly describe, the present invention, in one preferred embodiment thereof, comprises an article packaging machine for packaging articles such as bottles or cans into cardboard cartons. The packaging machine comprises a frame for supporting the elements of the machine and a carton conveyor mounted to the frame for conveying cartons sequentially along a predetermined carton path. An infeed conveyor assembly is positioned adjacent and along one side of the carton path for conveying articles along prescribed paths, grouping the articles into groups, and directing the article groups toward and into open cartons moving along the path. When a carton has received, through its open end, or open ends, the article group to be packaged therein, adhesive is applied to the flaps of the open ends of the cartons and the flaps are folded over onto themselves to close off the carton ends. The filled closed cartons then move into the compression section of the packaging machine, where pressure is applied to the closed flaps to set the adhesive and seal the cartons.

The compression section comprises a pair of brackets mounted on either side of the carton path. Each of the brackets has an upstanding vertically oriented front plate supporting a plastic backer plate that extends for a predetermined distance along a respective side of the carton path. The backer plates of the two brackets are oriented in spaced parallel relationship and face one another across the carton path.

Each of the brackets is mounted on a pair of transversely oriented linear bearings and is movable thereon toward and away from the carton path. Compression springs are provided for yieldably biasing each of the brackets, and thus biasing the facing upstanding backer plates, toward the carton path and toward the opposing bracket on the other side of the carton path.

A vertically oriented endless conveyor belt assembly is associated with each of the brackets. Each of the endless conveyor belt assemblies comprises a pair of sprockets positioned adjacent the ends of a respective one of the brackets. An endless flexible conveyor belt extends around the sprockets of each bracket and has an inner flight that extends along the face of the backer plate adjacent to the carton path. Thus, the inner flights of the two endless conveyor belts border the carton path and oppose each other thereacross. At least one of the sprockets of the endless conveyor belt assemblies is driven to move the inner flights of the belts in unison along the carton path in the direction of carton movement and synchronized therewith.

In operation, the brackets of the compression assemblies are inwardly spring biased toward each other such that the spacing between the opposing inner flights of the compression belts is slightly less than the expected minimum length of cartons to be processed through the machine. When a carton has been packaged with a group of articles and the flaps of its open end have been glued and folded over onto themselves, the carton moves into the compression section between the opposed inner flights of the compression belts. The movement of a carton between the belt flights urges the spring biased compression brackets slightly apart and away from each other on their respective linear bearings. Since the bracket on each side of the carton path is spring biased inwardly toward the other bracket, the brackets tend to spread apart by equal amounts thus keeping the cartons precisely centered in the carton path as they traverse the compression section.

The spring tension of the compression springs that bias the brackets together is selected so that the inward pressure provided by the springs is sufficient to hold the flaps of the cartons together with proper force to set the previously applied adhesive, thus sealing the flaps and closing the end of the container. Further, since the brackets, backer plates, and inner flights of the conveyor belts are biased toward each other substantially along their entire lengths, the compression provided to cartons moving between the inner flights of the belts is continuous and substantially unfluctuating along the entire length of the assembly. Thus, when a carton emerges from the compression section, the adhesive previously applied to the flaps is thoroughly set and the carton is securely closed.

If beverage containers having slightly smaller or slightly larger diameters are processed, the brackets of the compression section adjust their lateral positions automatically to accommodate the slightly different size cartons by moving in or out against the bias of their compression springs. As mentioned above each of the brackets moves in or out substantially the same distance to maintain the carton precisely in the center of the carton path.

As the cartons emerge from the compression section, they are gripped by the opposed belts of an ejector belt assembly. Like the compression belt assembly, the ejector belt assembly comprise, on each side of the carton path, a bracket mounted on a pair of transversely oriented linear bearings and movable thereon toward and away from the carton path. Compression springs are provided for yieldably biasing the brackets to inwardly disposed positions toward the carton path and toward each other. The brackets include upstanding front plates that border and extend along the carton path. An infeed pulley is mounted on each floating bracket at the upstream end of the assembly and respective idler pulleys are mounted on the downstream ends of the brackets. Endless ejector belts extend around the pulleys and each belt has an inner flight that rides along the front plate of its bracket. With this configuration, it will be seen that the infeed pulleys oppose each other across the carton path and float toward and away from each other along with their respective brackets.

The ejector belt assemblies are spring biased to an inwardly disposed position wherein the spacing between the opposing flights of the belts is slightly less than the smallest expected carton to be processed. In addition, the infeed pulleys are aligned with the belt line, i.e., with the planes of the inner flights of their belts. Thus, the infeed ends of the belts are not tapered as with prior designs where the infeed pulleys were offset slightly back from the belt line. With this configuration, each of the cartons is engaged and gripped by the ejector belts at substantially the same position on the carton path. When a carton is engaged by the pulleys, the floating ejector belt assembly spreads against the bias of its springs to grip the carton and accelerate it away from the compression belt assembly. The ejector belts are driven at the proper speed to insure that the cartons are accelerated away from the compression belt assembly at just the right rate to avoid either the leading or trailing pusher lugs impacting and damaging the cartons. Furthermore, the floating configuration of the infeed pulleys in conjunction with the fact that they are aligned with the belt line ensures that the cartons are engaged by the ejector belts at substantially the same location along the path regardless of the width of the carton. The result is that cartons are accelerated away from the compression section controllably and with consistency allowing for positive control while automatically compensating for variations in package dimensions.

Thus, it is seen that an article packaging machine is now provided with an improved compression section that overcomes the problems and shortcomings of the prior art. Specifically, the compression section provides opposed conveyor belt flights on either side of the carton path that are spring biased toward each other substantially along their entire lengths rather than at spaced locations therealong. Accordingly, constant inward pressure is applied to cartons as they move along the entire length of the compression section to set the adhesive and seal the ends of the carton securely shut. Further, the facing flights of the compression belts are adjusted automatically toward or away from each other as necessary to accommodate slightly varying carton widths resulting from slight variations in the diameters of beverage containers packaged in the cartons. In addition, the invention provides infeed pulleys on the ejector belt assemblies that float along with the brackets of the assemblies for precise reliable control of carton ejection from the carton path to avoid damage by the pusher lugs. Finally, while providing superior performance, the mechanism of the compression section of this invention is mechanically simple, reliable, easily maintained, and economical to manufacture relative to prior art designs. These and other objects, features, and advantages of the invention will become more apparent upon review of the detailed description set forth below when taken in conjunction with the accompanying drawings, which are briefly described as follows.

DETAILED DESCRIPTION OF THE PREFERRED EMBODIMENT

Figure 1:
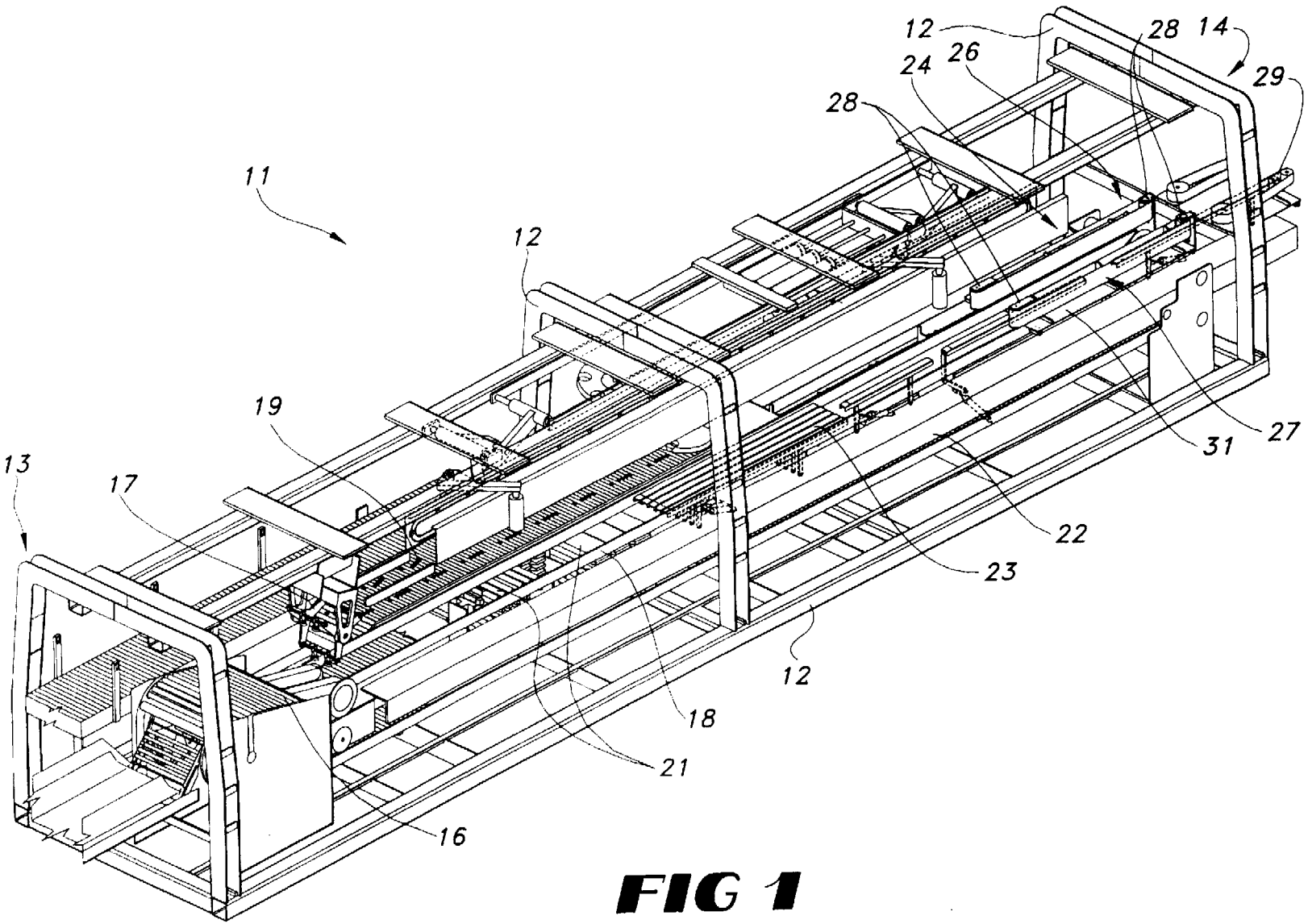
FIG. 1 is a perspective view of an article packaging machine that embodies principles of the present invention in a preferred form. Elements of the machine most pertinent to the present invention are shown in solid lines, while other elements are shown in phantom lines for clarity.

Referring now in more detail to the drawings, in which like numerals refer to like parts throughout the several views, FIG. 1 illustrates in perspective form an article packaging machine that embodies principles of the present invention. The packaging machine 11 has a walk-in frame 12 that supports the various functional elements of the machine and that provides overhead structure for supporting a retractable enclosure (not shown). The machine 11 has an infeed end 13 and a discharge end 14. A carton magazine assembly 16 functions to feed cardboard containers or cartons successively to the machine for subsequent packaging with articles. Typically, the cartons are fed by the carton magazine assembly 16 in a flattened or unopened configuration. A carton opening station 17 has a carton feed opening wheel with at least one suction cup thereon that engages the flattened cartons and pulls them open for delivery to the carton conveyor of the machine, where the cartons are conveyed along the carton path for packaging and closure.

The carton transport conveyor 18 defines an elongated carton path that extends from the carton opening station 17 to the discharge end 14 of the packaging machine. In operation of the machine, open cartons are conveyed along the carton path by means of the carton transport conveyor 18 toward the downstream end 14 of the packaging machine.

A selector belt conveyor assembly 19 is mounted to the frame adjacent the carton path and is driven to move along and beside the path to the right in FIG. 1. The conveyor assembly 19 includes a spaced series of selector wedges (not shown) and other functional elements designed to group beverage containers into groups of a predetermined size and direct the groups toward and into open cartons moving along the adjacent carton path. The configuration and function of these selector wedges in conjunction with the conveyor assembly 19 is described in detail in U.S. Pat. No. 5,546,734, and that description is hereby incorporated by reference. Unused selector wedges 21 are stowed in an out-of-the-way location in the machine so that appropriate selector wedges can be selected and installed for grouping articles into groups of various desired number and size.

Preferably, the packaging machine 11 is provided with a laterally adjustable accessory rail 22 that can be adjusted toward and away from the selector belt conveyor assembly 19 to adjust the width of the carton path to accommodate cartons of different sizes. Numerous independent elements of the machine that require lateral positioning when the machine is adjusted for a different size carton are mounted to the accessory rail and moved therewith so that these elements are all adjusted simultaneously with the accessory rail for easy set up when cartons of different sizes are to be processed.

As the accessory rail and its attached elements are adjusted laterally, the width of the carton path is adjusted correspondingly. Preferably, retractable bed plate assemblies, such as those indicated at 23, are adapted to be raised into the carton path as it is widened to provide support for the midsections of cartons moving along the path.

A compression section 24 is mounted adjacent the downstream end of the machine beyond the location on the carton path where containers are inserted into the open cartons. The compression section 24 comprises a spaced pair of compression belt assemblies 26 and 27 located on respective opposite sides of the carton path. Each of the compression belt assemblies has a vertically oriented endless belt with an inner flight that faces the carton path and that faces the inner flight of the opposing compression belt assembly. The endless belts extend around spaced sprockets 28 at the ends of the assemblies 26 and 27 and at least one of the sprockets of each assembly is driven to move the inner flights of the endless belts in unison with each other in the direction of and synchronized with carton movement along the carton path.

The compression section 24 is located along the carton path beyond the position where grouped beverage containers are inserted into open cartons and just beyond the section of the machine where adhesive is applied to the flaps of the open ends of the cartons and the flaps folded over onto themselves to close the carton ends. After the open end or ends of each carton is closed in this manner, the carton moves into the compression section 24 and between the opposed inner flights of the belts of the compression belt assemblies. These moving flights help to pull the cartons further along the carton path while applying inward pressure to the ends of the cartons to hold the carton flaps together while the previously applied adhesive sets. When the carton has reached the downstream end of the compression section 24, the adhesive has set and the flaps and open end(s) of the carton are sealed. At this point, the packaging operation is complete and the cartons are gripped between the opposed belts of an ejector belt assembly 29, described in detail below, which accelerates and ejects the packaged and closed cartons from the machine.

Each of the compression belt assemblies 26 and 27 of the compression section 24 is mounted to a corresponding bracket 31. The brackets 31, in turn, are movably mounted to the packaging machine on pairs of linear bearings for selective movement of the assemblies toward and away from the carton path and toward and away from each other. Each of the compression belt assemblies is spring biased toward the other assembly and toward the carton path. Thus, when cartons move between the compression belt assemblies, the assemblies spread apart slightly against the bias of their springs to accommodate slight variations in carton width while, at the same time, maintaining the necessary pressure to seal the ends of the cartons shut. If carton width should change during the packaging procedure, the spring biased compression belt assemblies adjust automatically in response.

In practice, the bracket 31 of the compression belt assembly 27 is mounted to the adjustable accessory rail of the packaging machine. Accordingly, as the accessory rail is adjusted in or out to accommodate a particular size carton, the spacing between the compression belt assemblies is automatically adjusted for the rough size of the carton. Fine adjustment for each carton that moves between the assemblies is made automatically by the free-floating spring biased mounting of the assemblies as mentioned above.

Figure 2:
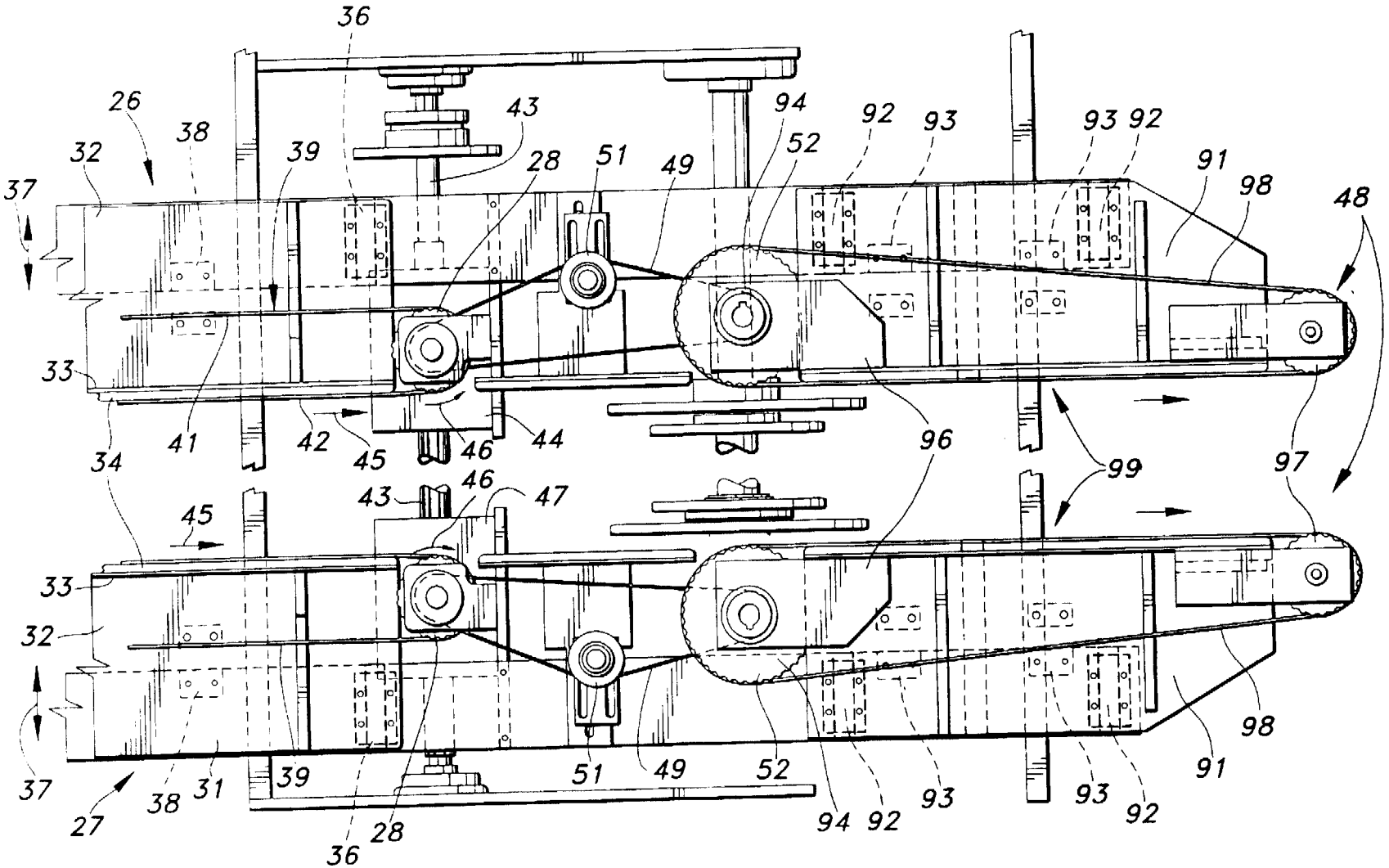
FIG. 2 is a top plan view of the compression and ejector sections of the packaging machine of FIG. 1 illustrating operational details thereof.

FIG. 2 is a top plan view of the compression and ejector belt assemblies of the present invention. The compression belt assembly 27 is a mirror image of the compression belt assembly 26. Accordingly, the assembly 26 will be described in detail herein and it will be understood that the assembly 27 is constructed and functions in the same way as the assembly 26.

The compression belt assembly 26 comprises a bracket 32 that is provided with a vertically oriented front plate 33. A plastic backer plate 34 is secured to the front plate 33 and extends therealong adjacent the carton path. Thus, the backer plates 34 of the two assemblies 26 and 27 face the carton path and face each other across the carton path. The bracket 32 is mounted to the frame of the packaging machine on a set of transversely oriented linear bearings 36 so that the bracket is movable toward and away from the carton path and toward and away from the other compression belt assembly 27 in the directions indicated by arrow 37. A spring block assembly 38 is arranged to bias the bracket 32 yieldably toward the carton path and toward the other compression belt assembly 27.

A vertically oriented endless conveyor belt 39 extends around sprockets 28 located adjacent the ends of assembly 26. The endless belt 39 has an outside flight 41 and an inside flight 42. The inside flight 42 of the belt 39 faces the carton path and rides along the face of backer plate 34. In practice, the backer plate 34 is made of a low friction plastic material so that the inner flight 42 of the belt can slide easily along the backer plate.

A drive shaft 43 is operatively coupled through gear box or transmission 44 to rotate the sprocket 28 in the direction indicated by arrow 46. An appropriate drive motor (not shown) is coupled to rotate the drive shaft 43 for rotating the sprocket 28. The drive shaft 43 extends from the gear box 44, below the carton path, to a second gear box 47 that is coupled to the sprocket 28 of the other compression belt assembly 27. In this way, rotation of the drive shaft drives the sprockets 28 of each of the compression belt assemblies to drive the endless conveyor belts 39 in directions 46. This, in turn, moves the inner flights 42 of the belts in the downstream direction of the machine as indicated by arrows 45. In practice, the belts are driven in synchronization with carton movement along the path so that inner flights 42 move at the same rate as the cartons.

Each of the sprockets 28 is coupled through a belt 49 and an idler 51 to the drive sprockets or infeed pulleys 52 of a respective ejector belt assembly 48. Since the infeed pulleys 52 are larger than the sprockets 28, the belts of the ejector belt assembly 48 are driven at a speed greater than the speed of the compression belt assembly belts. As discussed in more detail below, the ejector belt assemblies 48 functions to grip cartons as they pass beyond the compression belt assemblies and accelerate the cartons out of the machine and away from the compression belt assembly. The infeed pulleys 52 are sized so that the cartons are accelerated to just the right speed to pull the cartons away from their trailing pusher lugs as the lugs begin to rotate around their downstream sprockets so that the lugs do not give the cartons a kick that can blemish or mar the cartons.

Referring back to the compression belt assemblies 26 and 27, it will be seen that as cartons move into the compression section and between the opposed inner flights of the compression belts, inward pressure is applied to the ends of the cartons as they traverse the compression section. The pressure, in turn, holds the flaps of the carton ends together so that the adhesive, previously applied can set to seal the end of the carton shut before it is ejected from the machine.

Figure 3:
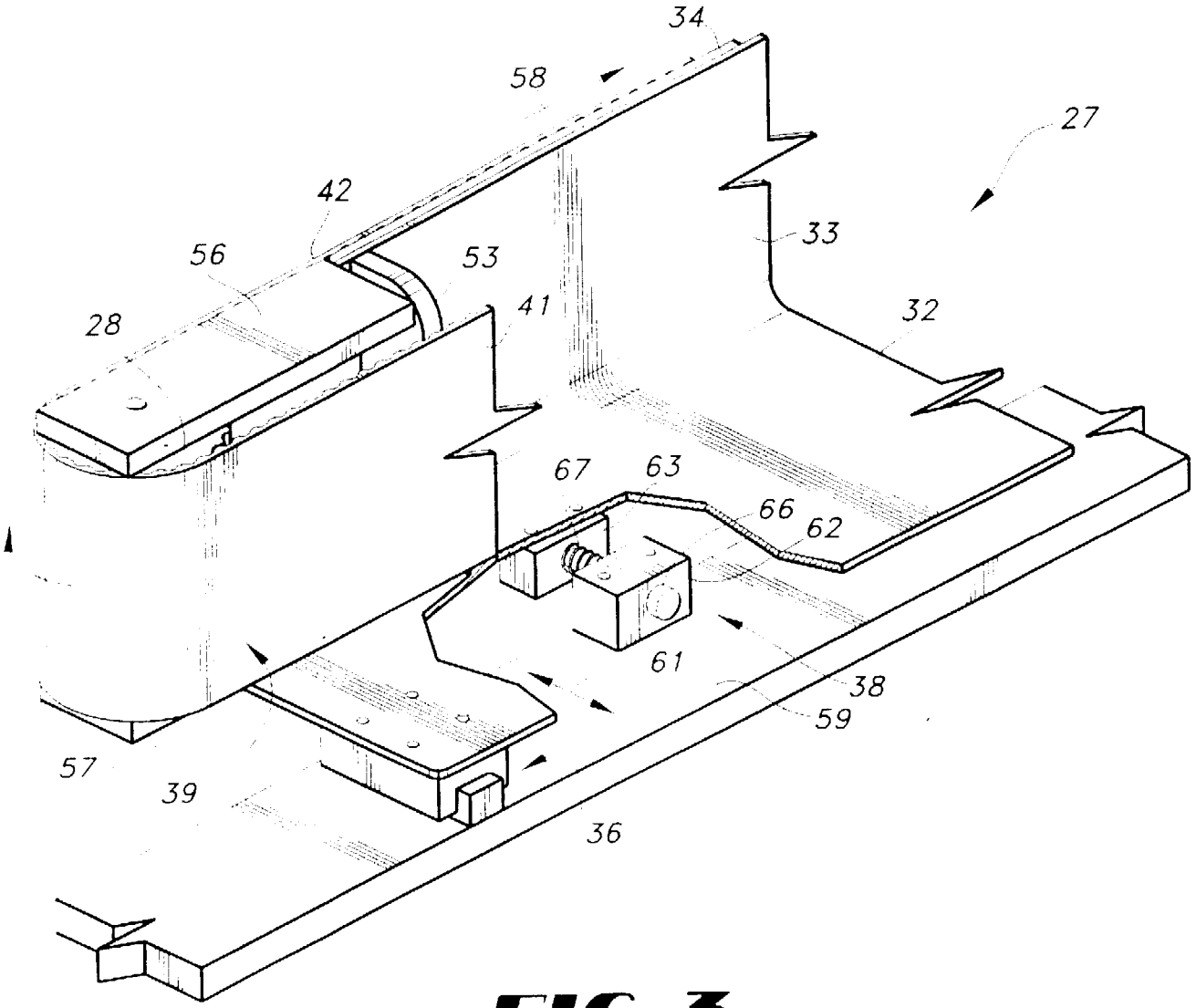
FIG. 3 is a perspective view illustrating the mounting of the compression section bracket to the machine and the spring biasing thereof toward an inwardly disposed position.

FIG. 3 is a perspective view of the other end of compression belt assembly 27 shown in FIG. 2. This figure illustrates the bracket 32 with its upstanding vertically oriented front plate 33. The plastic backer plate 34 is secured to the inner surface of front plate 33 and provides a surface along which the compression belt can slide during operation. Braces 53 are welded to bracket 32 to provide support for the upstanding front plate 33 and the backer plate 34.

The vertically oriented endless conveyor belt 39 extends around sprocket 28 and has an outer flight 41 and an inner flight 42. The sprocket 28 on this end of the compression belt assembly is mounted between spaced sprocket arms 56 and 57 that, in turn, are welded or otherwise secured to the bracket 32. The sprocket 28 thus floats with the bracket 32. In practice, the sprocket 28 can be offset slightly back from the belt line to avoid over compressing cartons at the pulley tangent points. The sprocket 28 on this end of the assembly is not driven but is an idler sprocket that functions to hold the belt 39 taut and keep it in line as it rounds the end of the assembly. In this regard, the endless conveyor belt 39 preferably is provided with teeth on its interior surface that mesh with teeth on the sprockets 28 to prevent longitudinal slippage of the belt. The belt 39 can also be provided with a longitudinally extending rib 72 (FIG. 4) that fits into a corresponding groove extending along the length of the backer plate 34. The cooperation of the rib with the groove tends to hold the inner flight 42 of the belt in proper vertical position as it traverses along the backer plate 34.

The compression belt assembly 27 is mounted to the accessory rail 59 of the packaging machine on a set of spaced apart laterally oriented linear bearings 36. Linear bearings 36 preferably are standard bearings available from many manufacturers and provide for free-floating lateral motion of the bracket 32 and thus the entire assembly 27 toward and away from the carton path in the directions indicated by arrows 61.

A spring block assembly 38 yieldably biases the bracket 32 and thus the compression belt assembly 27 to an inwardly extending position toward the carton path and toward the other compression belt assembly. The spring block assembly 38 comprises a spring block 62 that is secured to the accessory rail 59. A corresponding stop block 63 is secured to the underside of the bracket 32 and opposes the spring block 62 as shown in FIG. 3. A guide rod 64 (best seen in FIG. 4) is threadably secured to the stop block 63 and extends therefrom slidably through an opening formed in the spring block 62. An enlarged head 66 is formed on the free end of the guide rod 64 to limit the inward lateral movement of the compression belt assembly 27. A compression spring 67 surrounds the guide rod 64 and is compressed between the spring block 62 and the stop block 63. With this configuration, the bracket 32 and thus the assembly 27 is yieldably spring biased by spring block assemblies 38 to an inwardly disposed position toward the carton path and toward the opposed compression belt assembly 26. The opposed compression belt assemblies can thus be spread apart against the bias of their springs 67 by appropriate outward pressure applied to the inner flights of the endless belts 39.

In practice, the spring biased inwardly disposed positions of the opposed compression belt assemblies is set to space the opposed inner flights 42 apart a distance slightly less than the expected width of cartons to move between the assemblies. Thus, as a carton moves into position between the compression belt assemblies, each assembly is pushed out slightly against the bias of its compression springs. The springs, in turn, maintain compression on both ends of the carton as it moves between the assemblies. Further, slight variations in carton width due to variations in the diameter of containers packed in the cartons are accommodated automatically because the compression belt assemblies spring slightly farther apart or closer together as required to accommodate the width of the carton. Finally, since both the opposed compression belt assemblies are spring biased toward their inwardly disposed positions, each springs out by substantially the same amount as cartons pass therebetween. In this way, the cartons are maintained precisely in the center of the carton path and are not shifted to one side as has been the case with some prior art designs.

Figure 4:
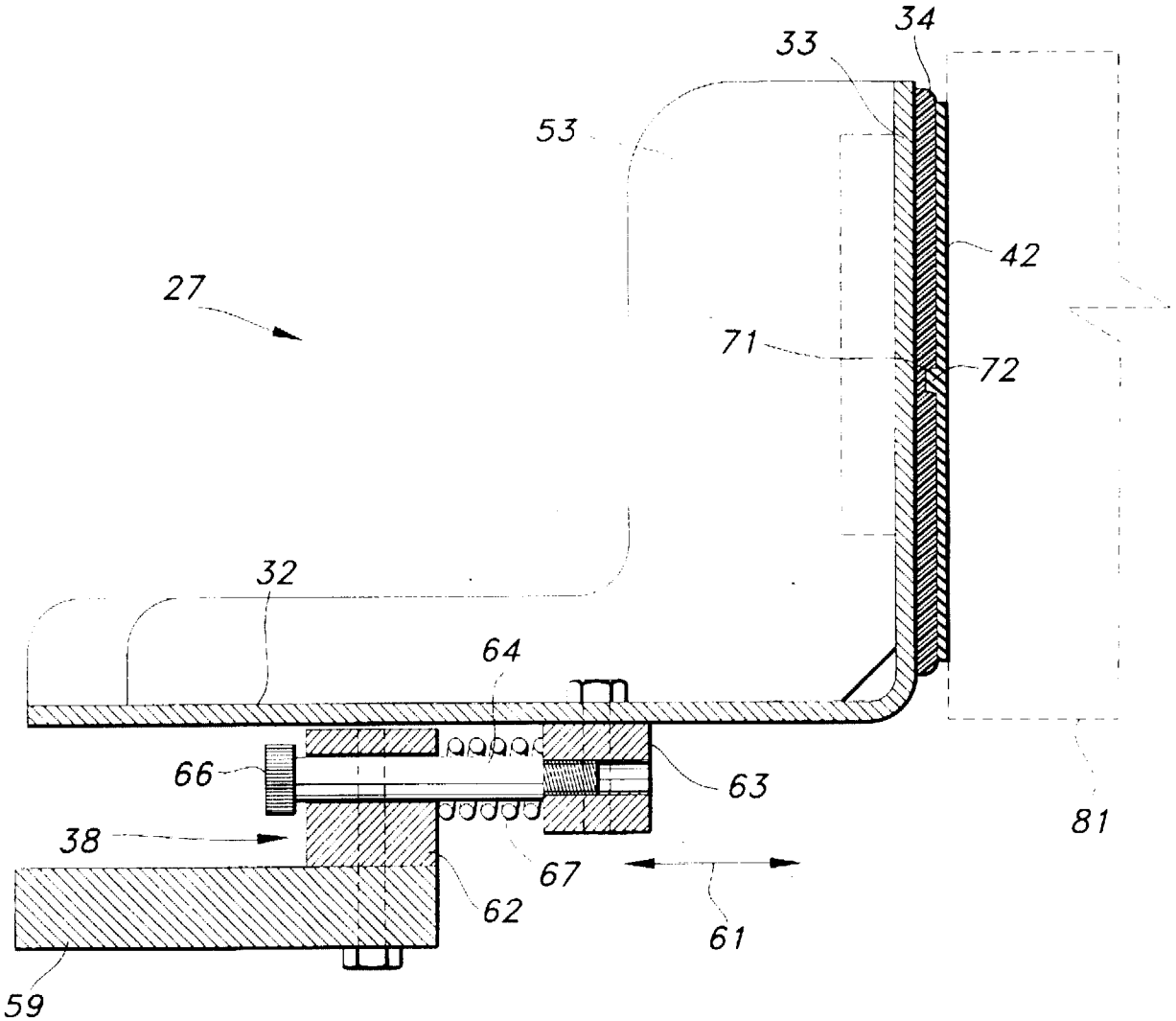
FIG. 4 is a sectional view illustrating a preferred method of spring biasing the compression section brackets of the present invention.

In FIG. 4, the compression belt assembly 27 is shown in cross-section through one of the spring block assemblies 38. Also shown is the backer plate 34, which is fixed to the front plate 33 of the bracket 32 to provide a low friction surface along which the inner flight 42 of the endless belt can move. The backer plate 34 is seen to be provided with a longitudinally extending center groove 71 that receives a corresponding rib 72 formed along the back of the endless belt. The rib 72 rides in the notch 71 as the belt moves along the backer plate 34 to hold the belt in its proper vertical position relative to the cartons moving along the path.

Also illustrated in FIG. 4 in phantom lines is the outline of a beverage carton 81 moving along the carton path and disposed against the inner flight 42 of the compression belt. It will be seen that the spring block assembly 38 holds the inner flight 42 against the end of the container 81 with a pressure determined by the tension of compression springs 67. This tension is selected so that the pressure provided is sufficient to hold the end flaps of the carton together with sufficient force and for a sufficient time to allow the adhesive previously applied to the flaps to set, thus sealing off the end of the carton.

When the carton moves beyond the elongated compression belt assemblies, the packaging process is complete and the carton is engaged by the ejector belt assemblies 48 (FIG. 2). Each of the ejector belt assemblies 48 is similar in construction to its corresponding compression belt assembly described above. In particular, each assembly 48 comprises a bracket 91 that is mounted on pairs of linear bearings 92 so that the brackets are free to float toward and away from the carton path and each other on their linear bearings. Spring block assemblies 93 are constructed and function like spring block assemblies 38 on the compression belt assemblies to bias the brackets 91 toward an inwardly disposed position.

Vertically oriented infeed pulleys 52 are rotatably journalled in bearings 94. The bearings 94, in turn, are mounted in bearing blocks 96 that are welded or otherwise secured to the floating brackets 91. With this configuration, the infeed pulleys 52 move laterally and float with the brackets 91 of the ejector belt assemblies 48. Discharge pulleys 97, which function as idlers, are mounted to the other end of brackets 91 and thus also float with the brackets. An endless belt 98 extends around the infeed and discharge pulleys of each of the ejector belt assemblies 48 and has an inner flight 99 that faces the carton path and faces the inner flight 99 of the opposing ejector belt assembly.

As mentioned above, the infeed pulley 52 of each of the ejector belt assemblies is driven through a belt 49 that, in turn, is coupled through an idler pulley 51 to the driven sprockets 28. With this configuration, only one drive is necessary to drive both the compression belt assemblies and the ejector belt assemblies. Since the infeed pulleys 52 are larger in diameter than the sprockets 28, the ejector belts 98 are driven at a higher speed than the compression belts. In practice, the diameter of infeed pulleys 52 is selected so that as cartons are gripped between the ejector belts, they are accelerated to pull them away from their trailing upstanding pusher lugs but not so fast as to cause them to run over the leading lugs in front of the cartons. In short, each carton is gently pulled away from its pocket between two sets of upstanding lugs so that neither set of lugs impacts the carton and causes damage thereto.

The brackets 91 of the ejector belt assemblies are spring biased to inwardly disposed positions wherein the spacing between the inner flights 99 of the ejector belts 98 is a bit less than the length of cartons to be processed through the machine. Accordingly, the infeed pulleys 52 are also biased toward each other since they are mounted to and float with the brackets 91. Further, the infeed pulleys are aligned with the inner flights of their belts so that the infeed ends of the belts are not tapered.

As a packaged and sealed carton begins to emerge from between the compression belt assemblies, its opposed leading edges are engaged by the ejector belts 98 at a tangent point on the infeed pulleys 52. Since the infeed pulleys are spring biased to a spacing less than the width of the carton, the tangent point at which the cartons engage the infeed pulleys is displaced slightly toward the compression belt assemblies. Further, since the infeed pulleys are aligned with their belt lines, the traction point where the cartons engage the belts does not vary significantly with carton width. Accordingly, the point along the carton path at which each carton engages the infeed pulleys 52 varies only by an insignificant amount from carton-to-carton, even where the cartons vary in width. Thus, the cartons are gripped by the ejector belts at the proper time regardless of the width of the carton.

Immediately after engaging the ejector belts at the infeed pulleys 52, the ejector belt assemblies begin to spread against the bias of their springs thus gripping the carton firmly and ejecting it on out of the machine. The spring biased floating nature of the ejector belt assemblies, like the compression belt assemblies, adjust the entire assembly for slight variations in carton width due to variations in the diameter of containers within the carton. Thus, the ejector belt assemblies with their floating infeed pulleys compensate automatically for carton width variation and assure that the cartons are initially gripped and pulled from between the compression belts at precisely the right time and that they are accelerated at just the right speed to prevent leading or trailing pusher lugs from damaging the cartons. When the cartons reach the discharge end by the ejector belt assemblies, they are ejected onto a carton conveyor, which transports the cartons to a holding station for further processing.

The invention has been described herein in terms of preferred embodiments and methodologies. It will be obvious to those skilled in the art, however, that various additions, deletions, and modifications might well be made to the illustrated embodiments without departing from the spirit and scope of the invention as set forth in the claims.

We claim:

1. An article packaging machine for packaging articles such as bottles or cans into preformed cartons, said packaging machine comprising:

a frame;

carton conveyor means mounted to said frame for conveying cartons along a predetermined carton path;

an infeed conveyor assembly on one side of said carton path for conveying articles along prescribed paths and directing the articles in groups toward open cartons moving along said carton path;

said carton path having an infeed end for receiving cartons to be conveyed along said carton path, and a discharge end from which cartons are discharged from said carton path;

a compression assembly mounted adjacent said discharge end of said carton path for applying inward pressure to the ends of filled cartons as the cartons move toward the discharge end of said carton path to seal the ends of the cartons shut;

said compression assembly comprising a first moving endless belt positioned on one side of said carton path with a flight of said first endless belt being positioned to bear a constant inward pressure against one end of the filled cartons as the cartons move along said carton path, and a second moving endless belt positioned on the opposite side of said carton path with a flight of said second endless belt being positioned to bear an equal said constant inward pressure against the opposite end of the respective filled cartons as the cartons move along said carton path, where said constant inward pressure is independent of the width of the cartons; and means for yieldably biasing said flights of said first and second moving endless belts toward each other substantially along the entire lengths of said flights for accommodating carton-to-carton variances in the distance between opposed ends of the cartons as the cartons move between said flights;

wherein said compression assembly maintains said cartons along a fixed centerline as the cartons travel the lengths of said flights along said carton path, and wherein each of said flights of said first and second endless belts has a front surface facing said carton path and a back surface opposite said front surface, said means for yieldably biasing said flights comprising a first bracket having a first upstanding backer plate positioned to bear against said back surface of one of said flights and a second bracket having a second upstanding backer plate positioned to bear against said back surface of the other end of said flights, linear bearings for movably mounting said first and second brackets to said frame for relative movement toward and away from each other, and biasing means for yieldably biasing said first and second brackets toward each other, and further comprising an alignment rib on the back surface of each of said flights and a corresponding aligned groove extending along each of said baker plates, said ribs riding in said grooves to maintain said flights in vertical alignment.

2. An article packaging machine as claimed in claim 1 and wherein said biasing means comprises a stop block mounted to each of said brackets, a corresponding spring block mounted to said frame adjacent each of said stop blocks, and a compression spring compressed between each spring block and its corresponding stop block.

3. An article packaging machine as claimed in claim 2 and further comprising an alignment rod projecting from each stop block slidably through its corresponding spring block, said compression spring surrounding said alignment rod between said blocks.

4. An article packaging machine as claimed in claim 1 and wherein each of said moving endless belts extends around a pair of spaced sprockets with at least one of said sprockets being driven to move said belt.

5. An article packaging machine as claimed in claim 4 and wherein at least one of said sprockets of each of said moving endless belts is mounted to said bracket.

* * * * *